US008854274B2

(12) United States Patent
Hung et al.

(10) Patent No.: US 8,854,274 B2
(45) Date of Patent: Oct. 7, 2014

(54) ANTENNA DEVICE WITH CHOKE SLEEVE STRUCTURES

(75) Inventors: Tzu-Chieh Hung, Taipei (TW); Saou-Wen Su, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 330 days.

(21) Appl. No.: 13/236,866

(22) Filed: Sep. 20, 2011

(65) Prior Publication Data

US 2012/0229357 A1 Sep. 13, 2012

(30) Foreign Application Priority Data

Mar. 9, 2011 (CN) ..... 2011 1 0058891

(51) Int. Cl.
*H01Q 1/48* (2006.01)

(52) U.S. Cl.
USPC ..... 343/814

(58) Field of Classification Search
USPC ..... 343/848, 700 MS, 702, 846–847
See application file for complete search history.

(56) References Cited

U.S. PATENT DOCUMENTS

2009/0213026 A1* 8/2009 Lindberg et al. ..... 343/848

* cited by examiner

*Primary Examiner* — Huedung Mancuso
(74) *Attorney, Agent, or Firm* — Rosenberg, Klein & Lee

(57) ABSTRACT

An unbalanced antenna includes a non-conductive substrate having one short edge, and two long edges connected respectively to two opposite ends of the short edge and parallel to each other, and an unbalanced antenna disposed proximate to the short edge of the non-conductive substrate and having a ground portion. A ground plane has side edges extending along the long edges of the non-conductive substrate, and is electrically coupled with the ground portion. The length of the ground plane is longer than a quarter of an equivalent wavelength corresponding to an operating frequency of the unbalanced antenna. A pair of choke sleeve structures are symmetrically disposed at opposite sides of the ground plane and spaced apart from the unbalanced antenna by a quarter of an equivalent wavelength corresponding to the operating frequency. Each choke sleeve structure has one end connected to the ground plane, and the other end extending in a direction away from the unbalanced antenna.

6 Claims, 11 Drawing Sheets x-z plane y-z plane x-y plane

ANTENNA DEVICE WITH CHOKE SLEEVE STRUCTURES

CROSS-REFERENCE TO RELATED APPLICATION

This application claims priority of Chinese Application No. 201110058891.2, filed on Mar. 9, 2011.

BACKGROUND OF THE INVENTION

1. Field of the Invention

The invention relates to an antenna, more particularly to a printed circuit board (PCB) antenna.

2. Description of the Related Art

The invention relates to an antenna, more particularly to a printed circuit board (PCB) antenna.

2. Description of the Related Art

With reference to FIGS. 1 and 2, a PCB antenna 30 commonly used in a small wireless device, such as a wireless USB device, has an unbalanced structure. Examples of the unbalanced antenna include a monopole antenna, a Planar Inverted F Antenna, etc. These types of antenna create image currents on the ground plane 32 of the PCB 31. These image currents will then create standing waves at the ground plane 32 and then can easily create problems such as side lobes and nulls in the radiation pattern of the antenna 30. The problems arise from the designs and structures of the products employing the antenna 30. In particular, the components on the PCB 31 are not standardized and the size of the ground plane 32 may vary. When the length of the ground plane 32 is less than one quarter wavelength of the operating frequency, the antenna 30 can have a good omnidirectional radiation pattern commonly seen in dipole antennas.

However, when the length of the PCB 31 is increased to accommodate more components, the length of the ground plane 32 usually exceeds one quarter wavelength of the operating frequency of the antenna 30. This then causes the image currents on the ground plane 32 to present standing waves and results in the nulls 33. The radiation direction for the antenna 30 will be pointed towards the PCB 31, causing the radiation pattern of the antenna 30 to have lots of side lobes and nulls. This not only affects the effectiveness of sending and receiving signals, but may also cause some electromagnetic interference to electrical components on the PCB 31.

SUMMARY OF THE INVENTION

Therefore, an object of the present invention is to provide an antenna device with choke sleeve structures to improve the radiation pattern of an unbalanced antenna.

According to this invention, an antenna device comprises a non-conductive substrate, an unbalanced antenna, a ground plane and a pair of choke sleeve structures. The non-conductive substrate has one short edge, and two long edges connected respectively to two opposite ends of the short edge and substantially parallel to each other. The unbalanced antenna is disposed on the non-conductive substrate proximate to the short edge of the non-conductive substrate, and has a ground portion. The ground plane is disposed on the non-conductive substrate, is located at one side of the unbalanced antenna, and is electrically coupled to the ground portion. The ground plane has two opposite side edges that extend along the two long edges of the non-conductive substrate. The ground plane has a length longer than a quarter of an equivalent wavelength corresponding to an operating frequency of the unbalanced antenna. The pair of choke sleeve structures are symmetrically disposed on the ground plane at locations which are spaced apart from the unbalanced antenna by about a quarter of an equivalent wavelength corresponding to the operating frequency. Each choke sleeve structure has a first end connected to the ground plane, and a second end extending in a direction away from the unbalanced antenna.

Preferably, the choke sleeve structures are symmetrically disposed on the ground plane at locations which are inwardly of the two opposite side edges of the ground plane. Each choke sleeve structure is an elongated metal line. There is a first gap between the second end of each of the choke sleeve structures and the ground plane. Each of said choke sleeve structures further has an inner side edge, and there is a second gap between the inner side edge and the ground plane.

Preferably, the choke sleeve structures are symmetrically disposed on the ground plane at locations which are outwardly of the two opposite side edges of the ground plane. Each choke sleeve structure is an elongated metal line and further has an inner side edge forming a gap with the ground plane.

Preferably, the choke sleeve structures separate the ground plane into a current active region located at one side of the choke sleeve structures proximate to the unbalanced antenna, a current restricting region where the choke sleeve structures are located, and a current suppressing region located at another side of the choke sleeve structures distal from the unbalanced antenna. The choke sleeve structures block the image current on the ground plane from flowing to the current suppressing region. Since the currents of the pair of choke sleeve structures and the neighboring ground plane are the same in magnitude, but opposite in direction, they cancel each other out. Also, by making the length of the current active region shorter than a quarter of an equivalent wavelength corresponding to the operating frequency of the unbalanced antenna, there will not be any nulls inside the current active region.

The effect of the present invention comes from the incorporation of a pair of choke sleeve structures at the locations approximately a quarter of an equivalent wavelength corresponding to the operating frequency of the unbalanced antenna away from the unbalanced antenna and at two sides of the ground plane of the non-conductive substrate. The choke sleeve structures change image current distribution on the ground plane. By putting the choke sleeve structures at the locations described above (approximately a quarter of an equivalent wavelength corresponding to the operating frequency away from the unbalanced antenna), random appearance of current nulls on the ground plane may be prevented and the side lobes and nulls of the antenna radiation pattern may be alleviated, causing the unbalanced antenna to have a good omnidirectional radiation pattern. Moreover, electrical components on the ground plane do not get electromagnetic interference from the antenna.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
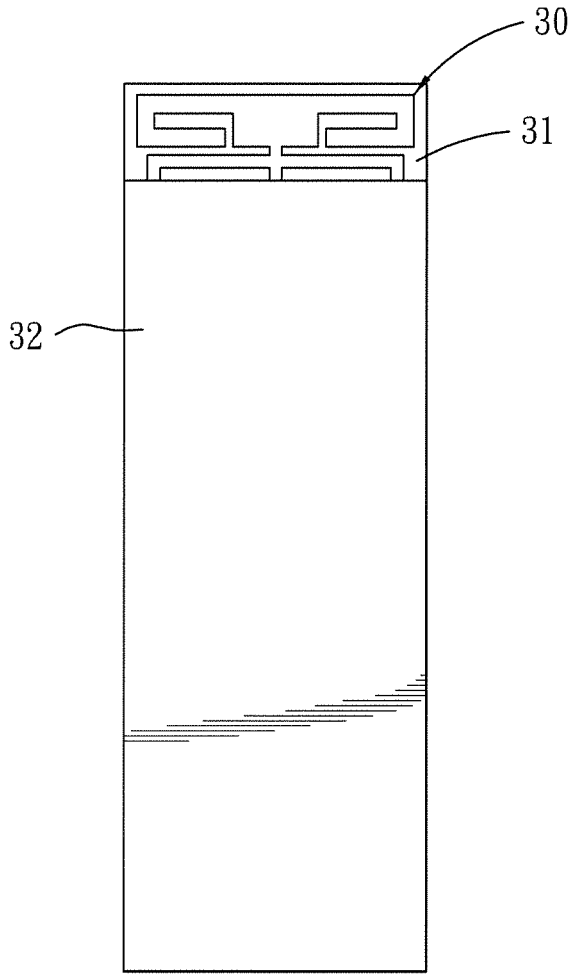
FIG. 1 PRIOR ART
FIG. 1 is a schematic view of a conventional printed circuit board (PCB) antenna.
Figure 2:
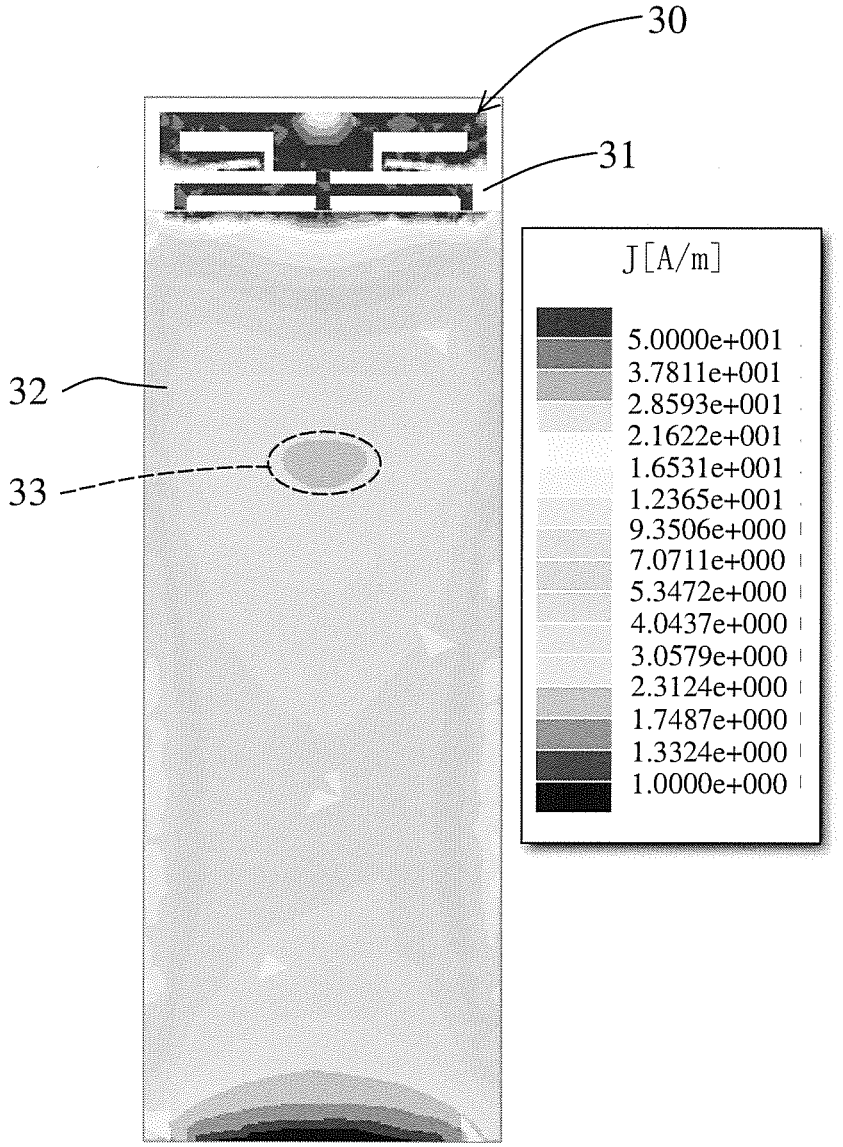
FIG. 2 PRIOR ART
FIG. 2 illustrates a simulation of image current distribution on a ground plane of the conventional PCB antenna.

Before the present invention is described in greater detail, it should be noted that like elements are denoted by the same reference numerals throughout the disclosure.

Figure 3:
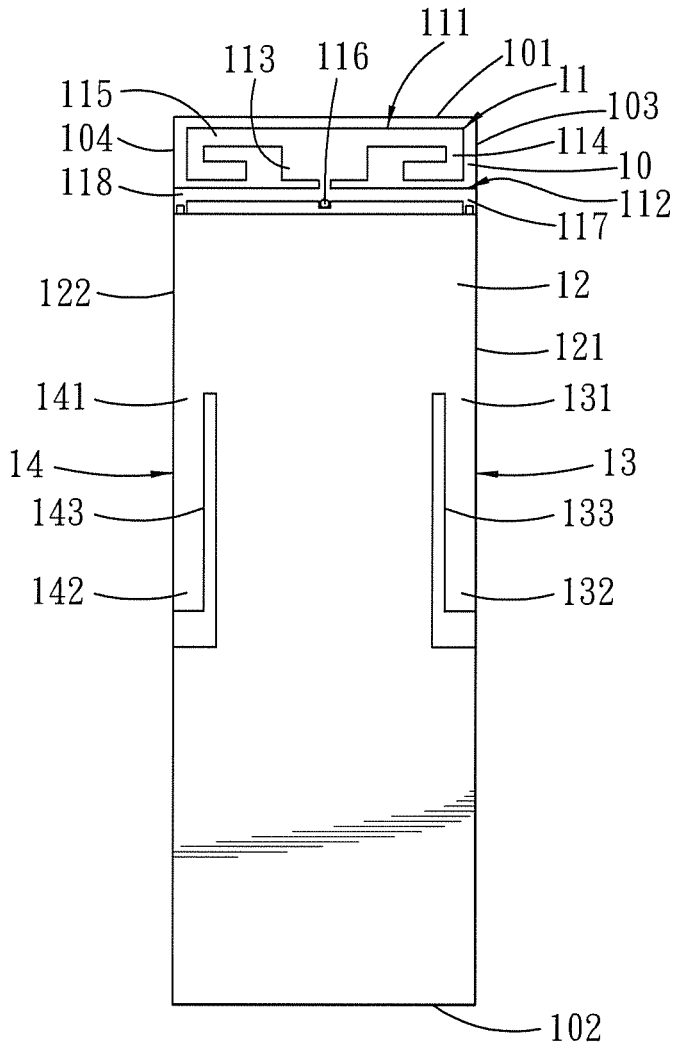
FIG. 3 is a schematic view of the first embodiment of an antenna device with a pair of choke sleeve structures according to the present invention.

Referring to FIG. 3, the first embodiment of an antenna device of the present invention comprises a non-conductive substrate (for example, the substrate of a printed circuit board) 10, an unbalanced antenna 11 set up on one end of the non-conductive substrate 10, and a ground plane 12 that is set up on the other end of the non-conductive substrate 10 and on the same plane as the unbalanced antenna 11.

The non-conductive substrate 10 in this embodiment is rectangular in shape, with first and second short edges 101, 102 arranged substantially parallel to each other, and first and second long edges 103, 104 arranged substantially parallel to each other and their ends connected to the ends of the short edges 101, 102.

The unbalanced antenna 11 is a one quarter wavelength resonant antenna. The unbalanced antenna 11 is disposed on the non-conductive substrate 10, such as by printing, proximate to the first short edge 101 of the non-conductive substrate 10. The unbalanced antenna 11 has a radiator unit 111 and a ground portion 112. The radiator unit 111 is generally T-shaped, and has an upright portion 113, and two radiating portions 114, 115. The two radiating portions 114, 115 symmetrically extend outwardly from the upright portion 113 proximate to the first short edge 101 toward the two long edges 103, 104. The ground portion 112 is set up on the other end of the upright portion 113 with respect to the two radiating portions 114, 115. The ground portion 12 has a centrally disposed feed-in point 116. Extending symmetrically from the feed-in point 116 toward the first and second long edges 103 and 104, respectively, are two L-shaped ground sections 117, 118. The upright portion 113 is coupled electrically to the feed-in point 116 of the ground portion 112. The above description of the unbalanced antenna 11 is considered as an embodiment of the present invention, and this invention is not limited to the disclosed embodiment. Other unbalanced antennas set up on a PCB are suitable for use in this invention.

The ground plane 12 is set up adjacent to the ground portion 112 of the unbalanced antenna 11 and is coupled electrically to distal ends of the L-shaped ground sections 117, 118. The ground plane 12 spans the first and second long edges 103, 104 of the non-conductive substrate 10 and is laid out on a surface of the non-conductive substrate 10. The ground plane 12 has a length longer than one quarter wavelength of the operating frequency (or central frequency) of the unbalanced antenna 11. First and second side edges 121, 122 of the ground plane 12 are parallel to the first and second long edges 103, 104. There is a pair of choke sleeve structures 13, 14 symmetrically disposed on the ground plane 12 at locations which are inwardly of the two side edges 121, 122 and which are spaced apart from the unbalanced antenna by the distance of about a quarter of an equivalent wavelength corresponding to the operating frequency (i.e., the distance can be slightly longer or shorter than a quarter of an equivalent wavelength corresponding to the operating frequency). Thus, the distance between the unbalanced antenna 11 and the pair of choke sleeve structures 13, 14 is not greater than one quarter wavelength of the operating frequency of the unbalanced antenna 11.

Figure 4:
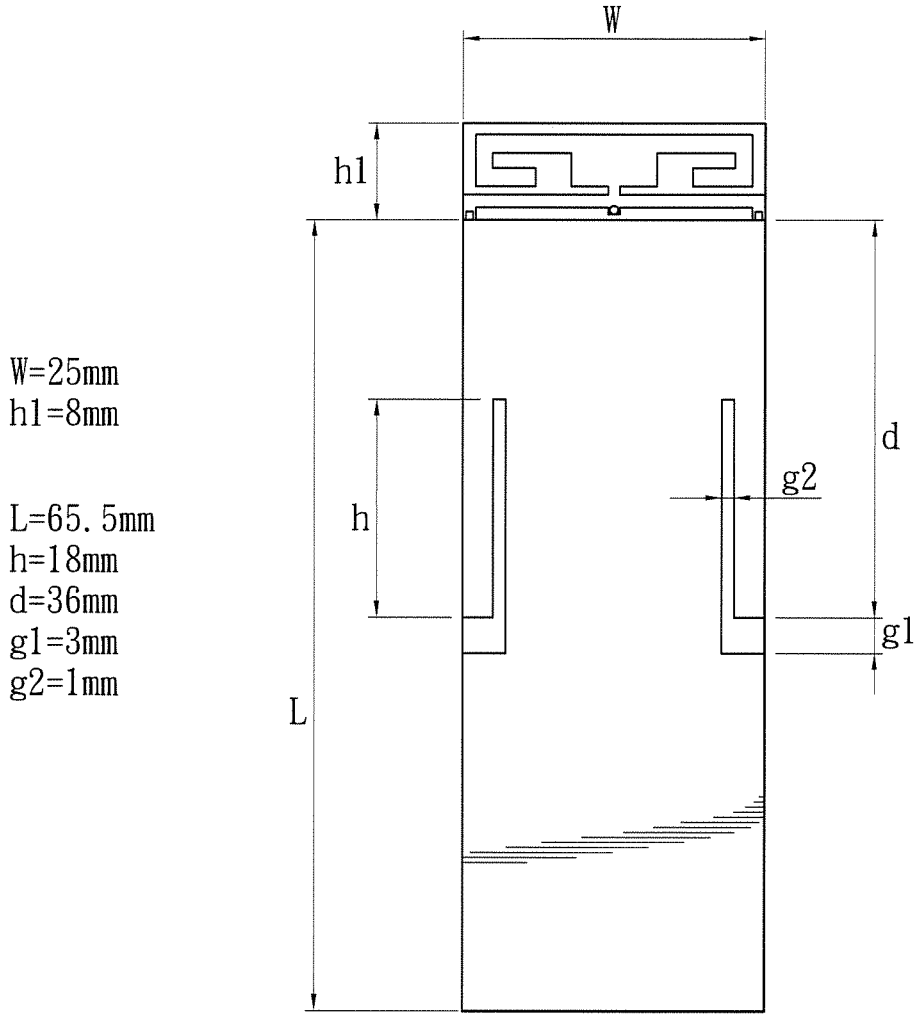
FIG. 4 is a schematic view to illustrate dimensions of the first embodiment.

Referring to FIGS. 3 and 4, each choke sleeve structure 13, 14 is an elongated metal line section with the length h approximately equal to one equivalent quarter wavelength of the operating frequency of the unbalanced antenna 11. First ends 131, 141 of the choke sleeve structures 13, 14 are connected to the ground plane 12. The second ends 132, 142 of the choke sleeve structures 13, 14 extend away from the unbalanced antenna 11. There is a first gap g1 between the second ends 132, 142 of each of the choke sleeve structures 13, 14 and the ground plane 12. Each of said choke sleeve structures 13, 14 further has an inner side edge 133, 143, and there is a second gap g2 between the inner side edge 133, 143 and the ground plane 12. There is no conductive material in the gaps g1, g2. The length h and the first gap g1 of the choke sleeve structures 13, 14 can be adjusted to adjust the matching impedance and the radiation pattern while the second gap g2 can be adjusted to adjust the radiation pattern of the antenna.

FIG. 4 shows antenna dimensions for operation in the 2.4 GHz frequency band. The non-conductive substrate 10 uses FR4 base plate with thickness of 1.6 mm but is not limited to the aforesaid disclosure.

Figure 5:
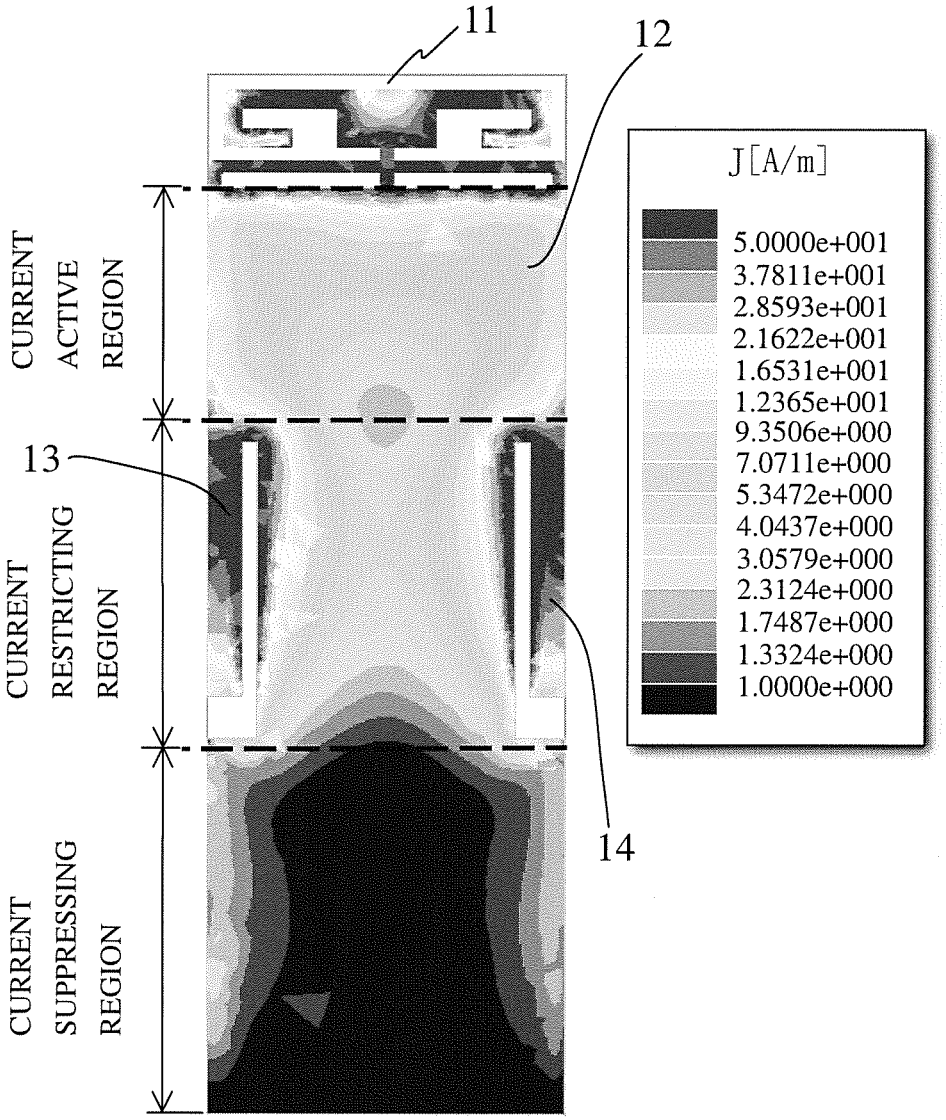
FIG. 5 illustrates a simulation of image current distribution on a ground plane of the first embodiment.
Figure 6A:
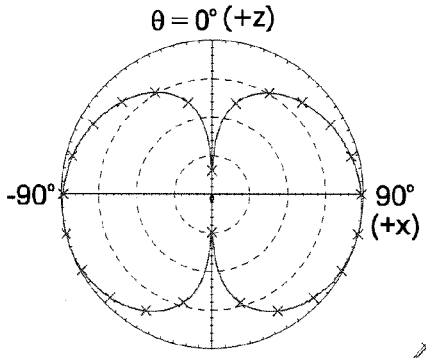
FIG. 6*a* is a chart showing the radiation pattern on the x-z plane of the first embodiment operating at 2.4 GHz frequency band.
Figure 6C:
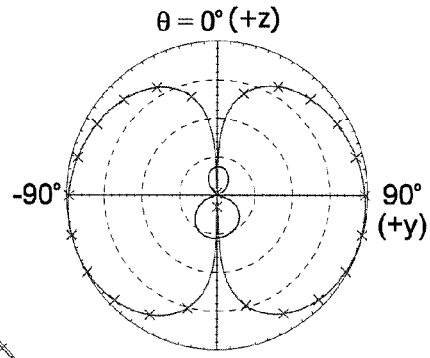
FIG. 6*c* is a chart showing the radiation pattern on the y-z plane of the first embodiment operating at 2.4 GHz frequency band.
Figure 6B:
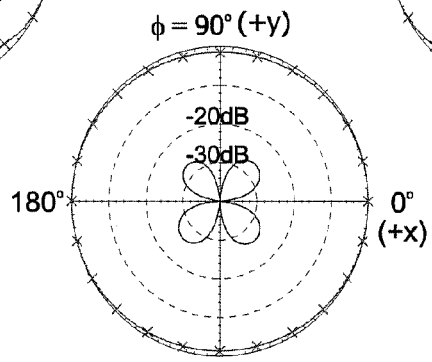
FIG. 6*b* is a chart showing the radiation pattern on the x-y plane of the first embodiment operating at 2.4 GHZ frequency band.
Figure 6B:
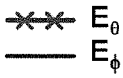
Figure 7A:
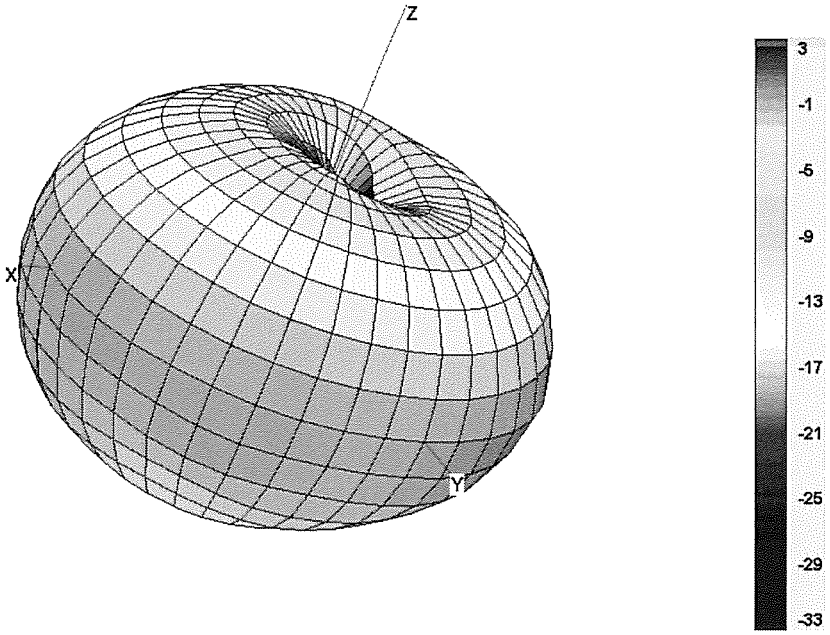
FIG. 7*a* is a 3 dimensional chart showing the radiation pattern of the first embodiment operating at 2.4 GHz frequency band.
Figure 7B:
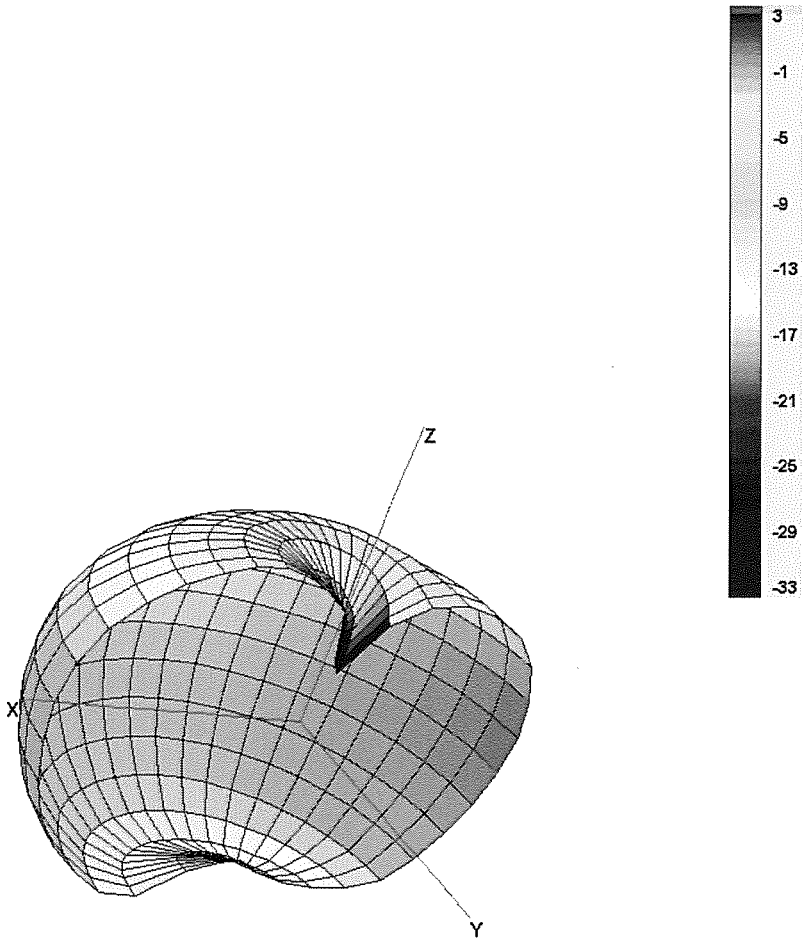
FIG. 7*b* is a section view, with respect to x-z plane, of the 3 dimensional chart shown in FIG. 7*a;*
Figure 7C:
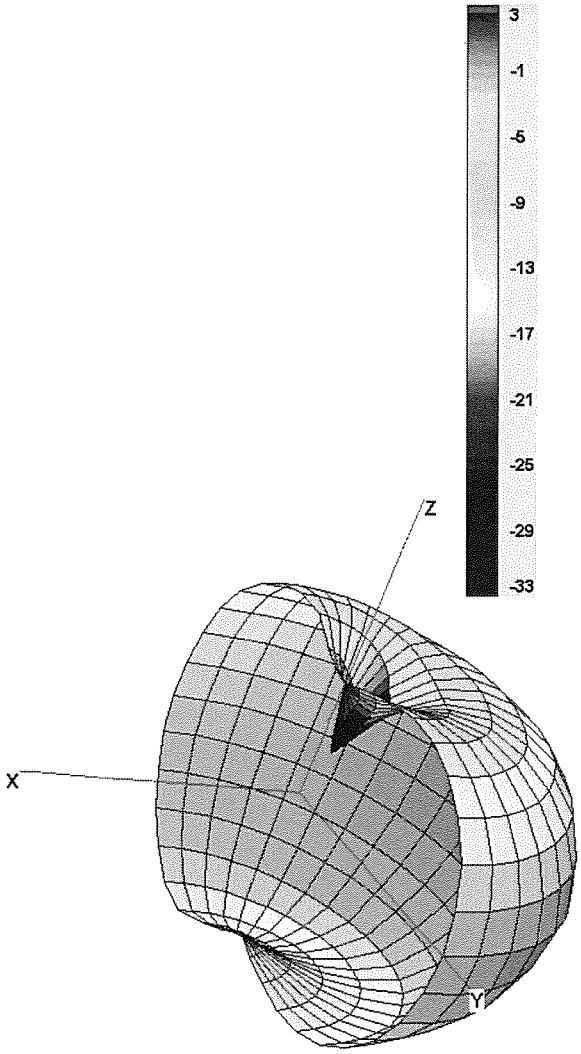
FIG. 7*c* is a section view, with respect to y-z plane, of the 3 dimensional chart shown in FIG. 7*a;*

Referring further to FIG. 5, the choke sleeve structures 13, 14 separate the ground plane 12 into a current active region located at one side of the choke sleeve structures 13, 14 proximate to the unbalanced antenna 11, a current restricting region where the choke sleeve structures 13, 14 are located, and a current suppressing region located at another side of the choke sleeve structures 13, 14 distal from the unbalanced antenna 11. When the unbalanced antenna 11 is operating at the 2.4 GHz frequency band, it can be seen from FIG. 5 that because of the influence of the choke sleeve structures 13, 14, the image currents on the ground plane 12 are blocked by the choke sleeve structures 13, 14 from flowing to the current suppressing region such that the current is very weak in the current suppressing region. The strength of the current is strongest at the current restricting region where the choke sleeve structures 13, 14 are set up. Since the currents of the narrow elongated metal line section of the choke sleeve structures 13, 14 and the neighboring ground plane 12 are the same in magnitude, but opposite in direction, they cancel each other out, which in turn results in low radiation energy. On the contrary, as the length of the current active region is not longer than one quarter wavelength of the operating frequency of the unbalanced antenna 11, there will not be any nulls inside the current active region. With the current distribution of the unbalanced antenna 11 and the current active region, the radiation patterns shown in FIGS. 6*a* to 6*c* and 7*a* to 7*c* can be achieved where the omnidirectional radiation pattern is similar that of the common dipole antenna.

Figure 8:
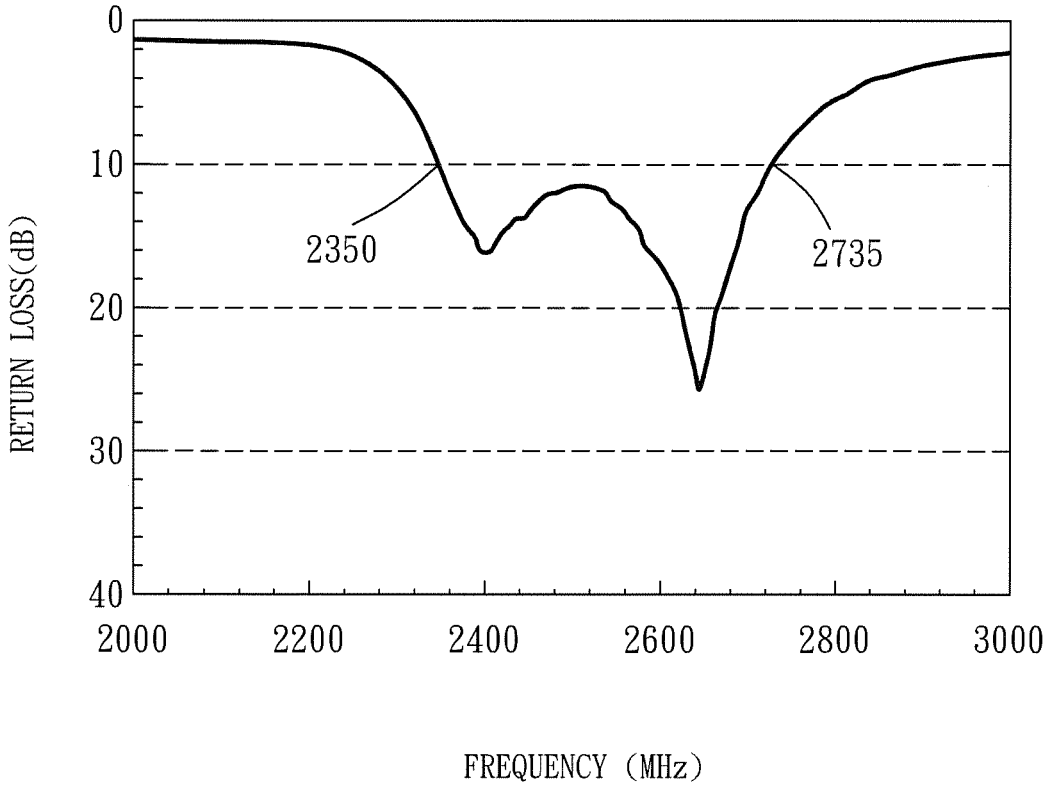
FIG. 8 is a plot of return loss vs frequency measured for the first embodiment.

FIG. 8 shows the result of the measurement of the reflective coefficients of the unbalanced antenna 11 operating at the 2.4 GHz frequency band. From the figure, the 10 dB return loss of the unbalanced antenna 11 has a bandwidth of 385 MHz (2350 MHz-2735 MHz).

As can be evident from the above description, the present invention incorporates a pair of choke sleeve structures 13, 14 at locations which are approximately a quarter of an equivalent wavelength corresponding to the operating frequency of the unbalanced antenna 11 away from the unbalanced antenna 11 and at two sides of the ground plane 12 of the non-conductive substrate 10. The choke sleeve structures 13, 14 change image current distribution on the ground plane 12. By putting the choke sleeve structures 13, 14 at the locations described above (approximately a quarter of an equivalent wavelength corresponding to the operating frequency away from the unbalanced antenna 11), random appearance of current nulls on the ground plane 12 may be prevented and side lobes and nulls of the antenna radiation pattern may be alleviated, causing the unbalanced antenna 11 to have a good omnidirectional radiation pattern. Moreover, electrical components on the ground plane 12 do not get electromagnetic interference from the antenna.

Also, as the choke sleeve structures 13, 14 are disposed inwardly of the two side edges 121, 122 of the ground plane 12, area of the non-conductive substrate 10 is not increased, the choke sleeve structures 13, 14 do not take up much space on the non-conductive substrate 10, and the arrangements of the electrical components would not be affected.

Figure 9:
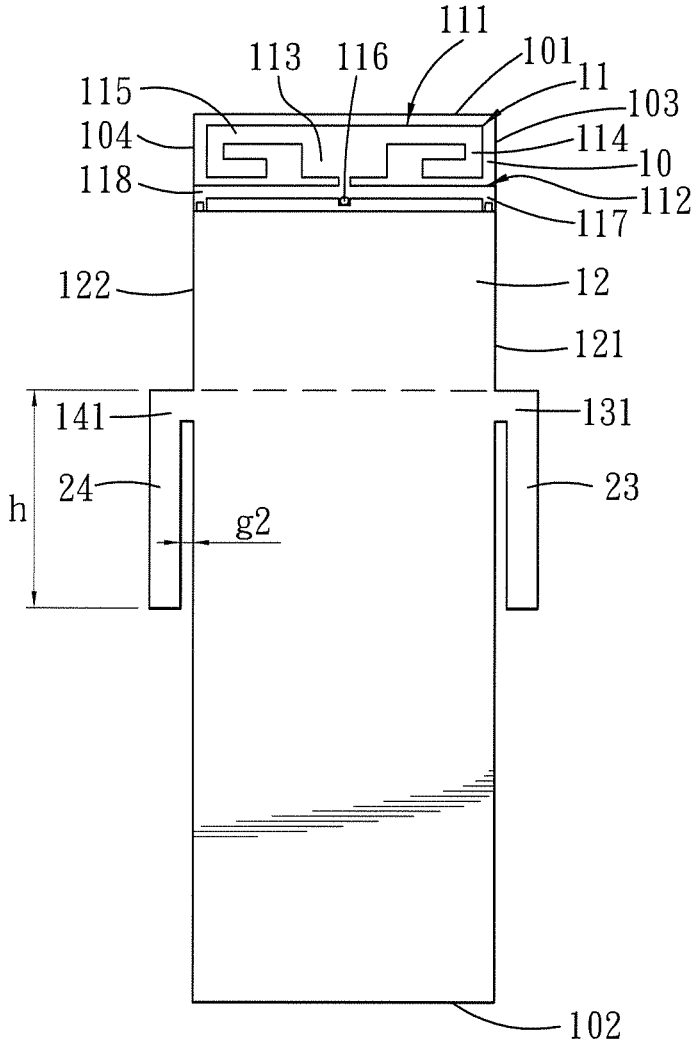
FIG. 9 is a schematic view of the second embodiment of an antenna device with choke sleeve structures according to the present invention.

FIG. 9 shows the second embodiment of the present invention. Unlike the first embodiment, the choke sleeve structures 23, 24 are set up outwardly of the side edges 121, 122 of the ground plane 12, and form a respective gap g2 with the ground plane 12. The rest of the embodiment is set up exactly the same as the first embodiment and is therefore not further described here. The choke sleeve structures 23, 24 cause the same effects as the choke sleeve structures 13, 14, by confining the image currents on the ground plane 12 in the current active region above the current restricting area created by the choke sleeve structures 23, 24, which alleviates side lobes and nulls of the antenna radiation pattern, causing the unbalanced antenna 11 to have a good omnidirectional radiation pattern and avoiding electrical components on the ground plane 12 from getting electromagnetic interference from the antenna.

As described above, the above embodiments disclose a rectangular PCB set up with the unbalanced antenna 11 and the ground plane 12. At approximately the distance of a quarter of an equivalent wavelength corresponding to the operating frequency (central frequency) from the unbalanced antenna 11 and at the two side edges 121, 122 of the ground plane 12, there are the choke sleeve structures 13, 14 or 23, 24 made up of narrow elongated metal line sections, and having one end grounded by connecting with the ground plane 12 and the other end extending away from the unbalanced antenna 11. The image currents on the ground plane 12 are restricted in the current restricting region created by the choke sleeve structures 13, 14, or 23, 24 and suppressed at the current suppressing area which is distal from the unbalanced antenna 11 and on the other side of the current restricting region where the choke sleeve structures 13, 14 or 23, 24 are installed. This restricts the current to be in the current active region proximate to the unbalanced antenna 11 which may alleviate side lobes and nulls of the antenna radiation pattern and causes the antenna to have a good omnidirectional radiation pattern. Moreover, the electrical components on the PCB (ground plane 12) do not get electromagnetic interference from the antenna.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna device comprising:

a non-conductive substrate having a short edge, and two long edges connected respectively to two opposite ends of said short edge and substantially parallel to each other;

an unbalanced antenna being disposed on said non-conductive substrate proximate to said short edge of said non-conductive substrate and having a ground portion;

a ground plane disposed on said non-conductive substrate, located at one side of said unbalanced antenna, and electrically coupled to said ground portion, said ground plane having two opposite side edges that extend along said two long edges of said non-conductive substrate, said ground plane having a length longer than a quarter of an equivalent wavelength corresponding to an operating frequency of said unbalanced antenna; and a pair of choke sleeve structures symmetrically disposed on said ground plane at locations which are inwardly of said two opposite side edges of said ground plane and which are spaced apart from said unbalanced antenna by about a quarter of the equivalent wavelength corresponding to the operating frequency, each of said choke sleeve structures having a first end connected to said ground plane, and a second end extending in a direction away from said unbalanced antenna.

2. The antenna device according to claim 1, wherein each of said choke sleeve structures is an elongated metal line section, wherein there is a first gap between said second end of each of said choke sleeve structures and said ground plane, wherein each of said choke sleeve structures further has an inner side edge, and there is a second gap between said inner side edge and said ground plane.

3. The antenna device according to claim 1, wherein said choke sleeve structures separate said ground plane into a current active region located at one side of said choke sleeve structures proximate to said unbalanced antenna, a current restricting region where said choke sleeve structures are located, and a current suppressing region located at another side of said choke sleeve structures distal from said unbalanced antenna.

4. An antenna device comprising:

a non-conductive substrate having a short edge, and two long edges connected respectively to two opposite ends of said short edge and substantially parallel to each other;

an unbalanced antenna being disposed on said non-conductive substrate proximate to said short edge of said non-conductive substrate and having a ground portion;

a ground plane disposed on said non-conductive substrate, located at one side of said unbalanced antenna, and electrically coupled to said ground portion, said ground plane having two opposite side edges that extend along said two long edges of said non-conductive substrate, said ground plane having a length longer than a quarter of an equivalent wavelength corresponding to an operating frequency of said unbalanced antenna; and a pair of choke sleeve structures symmetrically disposed on said ground plane at locations which are outwardly of said two opposite side edges of said ground plane and which are spaced apart from said unbalanced antenna by about a quarter of the equivalent wavelength corresponding to the operating frequency, each of said choke sleeve structures having a first end connected to said ground plane, and a second end extending in a direction away from said unbalanced antenna.

5. The antenna device according to claim 4, wherein each of said choke sleeve structures is an elongated metal line section, and further has an inner side edge forming a gap with an adjacent one of said opposite side edges of said ground plane.

6. The antenna device according to claim 4, wherein said choke sleeve structures separate said ground plane into a current active region located at one side of said choke sleeve structures proximate to said unbalanced antenna, a current restricting region where said choke sleeve structures are located, and a current suppressing region located at another side of said choke sleeve structures distal from said unbalanced antenna.

* * * * *